US008037637B2

(12) United States Patent
Odom, Jr.

(10) Patent No.: US 8,037,637 B2
(45) Date of Patent: Oct. 18, 2011

(54) TREE STAND

(76) Inventor: Harold A. Odom, Jr., Missouri City, TX (US)

( * ) Notice: Subject to any disclaimer, the term of this patent is extended or adjusted under 35 U.S.C. 154(b) by 406 days.

(21) Appl. No.: 12/266,117

(22) Filed: Nov. 6, 2008

(65) Prior Publication Data

US 2009/0121114 A1 May 14, 2009

Related U.S. Application Data

(63) Continuation-in-part of application No. 11/844,187, filed on Aug. 23, 2007, now abandoned.

(51) Int. Cl.
*A47G 7/02* (2006.01)

(52) U.S. Cl. ..... 47/40.5; 47/42; 248/519; 248/523; 248/534; 248/539

(58) Field of Classification Search ..... 248/511, 248/519, 516, 524, 528, 534, 539, 150, 351, 248/407, 429, 188.8, 188.91, 310, 230.1, 248/346.01, 346.03; 47/40.5, 42, 43
See application file for complete search history.

(56) References Cited

U.S. PATENT DOCUMENTS

| | | | | | |
|---|---|---|---|---|---|
| 1,160,698 | A | | 11/1915 | Diederichs | |
| 2,444,390 | A | | 6/1948 | White | |
| 2,594,187 | A | | 4/1952 | Levitt | |
| 2,689,701 | A | * | 9/1954 | Whitaker | 248/524 |
| 2,899,156 | A | | 8/1959 | Marcucci | |
| 2,931,604 | A | * | 4/1960 | Weddle | 47/40.5 |
| 2,933,274 | A | | 4/1960 | Mausolf | |
| 3,073,558 | A | | 1/1963 | De Klotz | |
| 3,164,351 | A | | 1/1965 | Rembowski | |
| 3,227,405 | A | | 1/1966 | Layton | |
| 3,353,773 | A | | 11/1967 | Budd | |
| 3,405,896 | A | | 10/1968 | Eby | |
| 3,815,854 | A | | 6/1974 | Zipser | |
| 3,838,838 | A | * | 10/1974 | Seaman, Jr. | 248/537 |
| 3,861,629 | A | | 1/1975 | Merrill | |
| 4,156,323 | A | | 5/1979 | Scheffler | |
| 4,190,983 | A | * | 3/1980 | Rostomily | 47/40.5 |
| 4,477,049 | A | | 10/1984 | Davis | |
| 4,571,882 | A | | 2/1986 | Capen | |
| 4,894,949 | A | | 1/1990 | Anderson | |
| 4,913,395 | A | | 4/1990 | Juhas | |
| 5,074,514 | A | | 12/1991 | Smith | |
| 5,114,113 | A | | 5/1992 | Krinner | |
| 5,249,772 | A | | 10/1993 | Montie, Jr. | |
| 5,375,808 | A | | 12/1994 | Roy | |
| 5,492,301 | A | * | 2/1996 | Hauser | 248/516 |
| 5,492,302 | A | | 2/1996 | Odom | |
| 5,590,865 | A | | 1/1997 | Odom | |
| 5,605,315 | A | * | 2/1997 | Hartung et al. | 248/523 |
| 6,042,077 | A | * | 3/2000 | Shoesmith | 248/523 |
| 6,536,723 | B1 | | 3/2003 | Nakatani | |
| 6,719,250 | B2 | * | 4/2004 | FitzSimons | 248/166 |
| 6,763,627 | B1 | | 7/2004 | Kaempe | |
| 6,920,834 | B1 | | 7/2005 | Pehta | |

(Continued)

*Primary Examiner* — Terrell McKinnon
*Assistant Examiner* — Todd M. Epps
(74) *Attorney, Agent, or Firm* — Winstead PC

(57) ABSTRACT

A stand for a tree comprises a base for receiving a trunk of the tree, wherein the base provides a top portion, and a plurality of attachment points positioned along a periphery of the top portion. The stand further comprises a plurality of bracing supports. Each bracing support comprises a first end, wherein said first end is coupled to one of the plurality of attachment points, and a second end, wherein said second end is equipped to engage the trunk of the tree.

10 Claims, 11 Drawing Sheets

U.S. PATENT DOCUMENTS 7,124,985 B2 10/2006 Crain
7,176,366 B1 2/2007 Bruce
2005/0029426 A1 2/2005 Washick
2005/0230593 A1 10/2005 Wynn

* cited by examiner

FIG. 9
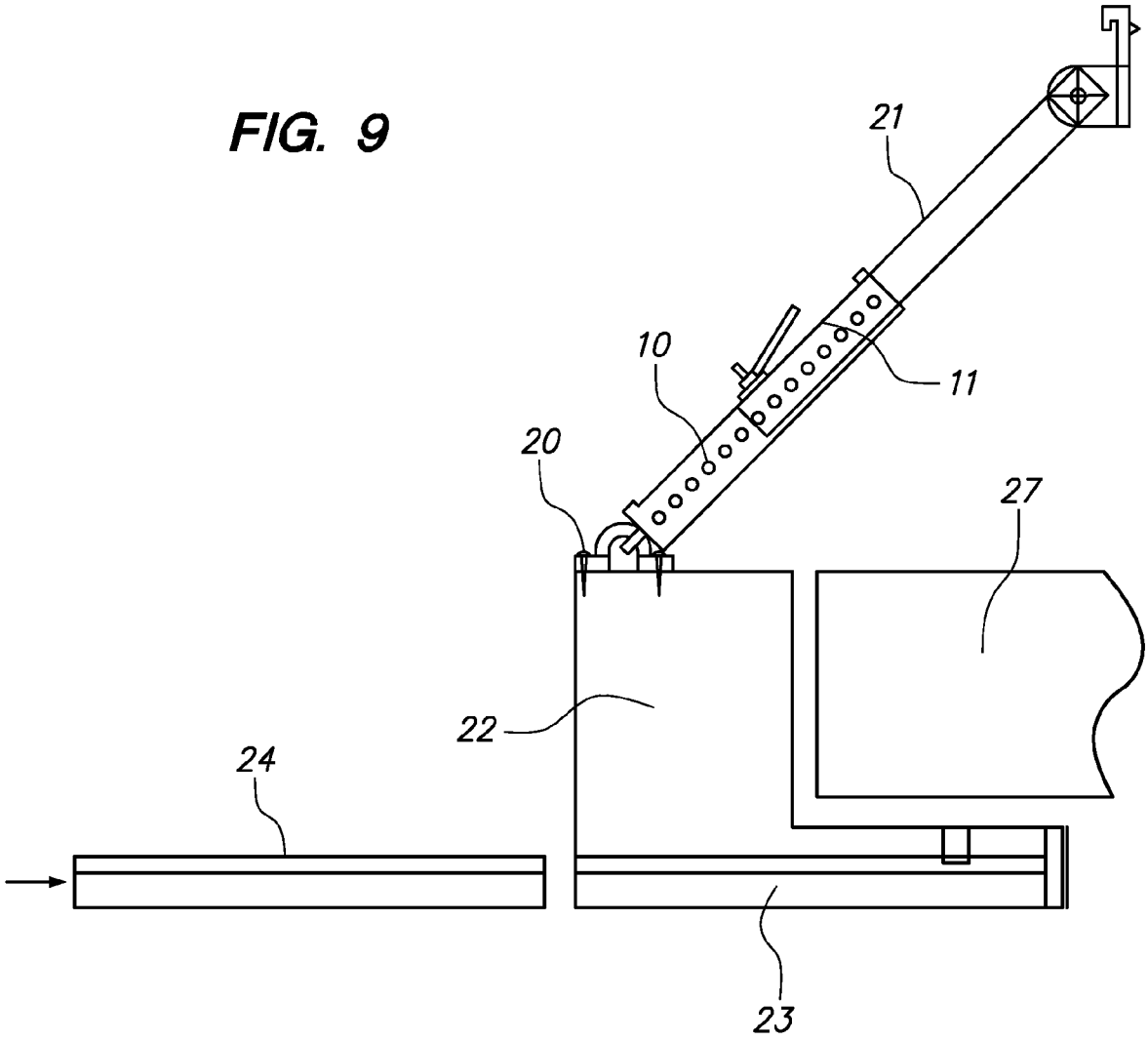
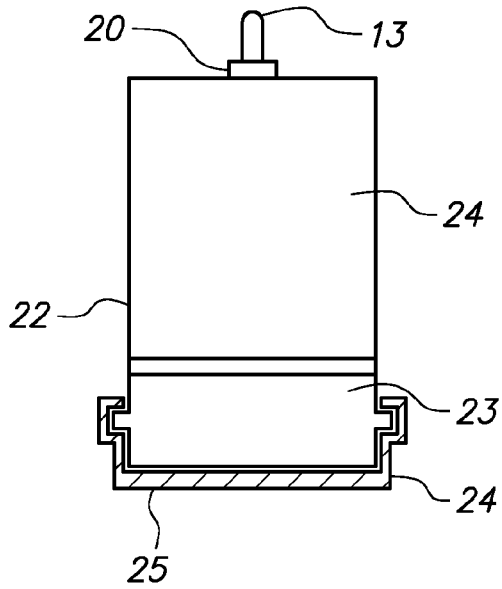
FIG. 10

TREE STAND

RELATED APPLICATIONS

The present application is a Continuation-in-Part (CIP) of U.S. patent application Ser. No. 11/844,187 filed Aug. 23, 2007. U.S. patent application Ser. No. 11/844,187 is herein incorporated by reference.

TECHNICAL FIELD

The present disclosure relates in general to a device and method for displaying harvested and artificial trees, poles and the like.

BACKGROUND

Devices designed for the display of Christmas trees generally enable users to properly stand the tree vertically and preferably insure that once positioned, the tree will remain in such a position. Dangers associated with an accidental tipping of the tree include breaking electric light bulbs, igniting the Christmas trees, damaging decorations, and spilling liquid from reservoirs used to supply water and nutrients.

A number of devices have been developed that operate effectively only by removing a substantial portion of side branches around the trunk of the tree. A connecting means is typically limited to bracing the tree only to the height that the branches have been removed in these systems.

Other devices that have been developed provide screws to attach fixed length braces to the tree only after the tree has been placed in the intended vertical position. Such devices generally require all the screws to all the braces be removed in order to perform any subsequent adjustment to the position of the tree.

One particular device uses a movable receptacle for the cut end of the tree in combination with a series of springs and chains to accomplish vertical display. Though the receptacle can be positioned to accommodate crooked trunks, the clamp bolts must be all loosened in order to move the receptacle to a new position to adjust the displayed tree to a more desired position. This new position is totally dependent on the resistance of opposing springs to maintain the position selected. The size of the reservoir is limited by the amount of free travel necessary along each of the guideways needed to accomplish adjustment. This limitation also limits the size of the tree trunk which can be placed in the stand.

In view of the foregoing, there is a need for the development of a device which may position a display tree in a substantially vertical position that is readily adjustable and does not require the exfoliation of considerable amounts of side branches, which detracts from the aesthetic look of the tree.

SUMMARY OF THE INVENTION

The foregoing has outlined some of the features and technical advantages of the present invention in order that the detailed description of the invention that follows may be better understood. Additional features and advantages of the invention will be described hereinafter which form the subject of the claims of the invention.

In view of the foregoing and other considerations, the present inventions relate to a stand for a tree comprises a base for receiving a trunk of the tree, wherein the base provides a top portion, and a plurality of attachment points positioned along a periphery of the top portion. The stand further comprises a plurality of bracing supports. Each bracing support comprises a first end, wherein said first end is coupled to one of the plurality of attachment points, and a second end, wherein said second end is equipped to engage the trunk of the tree.

The foregoing has outlined some of the features and technical advantages of the present invention in order that the detailed description of the invention that follows may be better understood. Additional features and advantages of the invention will be described hereinafter which form the subject of the claims of the invention.

DESCRIPTION OF THE DRAWINGS

The foregoing and other features and aspects of the present invention will be best understood with reference to the following detailed description of a specific embodiment of the invention, when read in conjunction with the accompanying drawings, wherein:

FIG. 9: shows side view of a cross-member with extension rail and base extension;

FIG. 10: shows a cross-section view of extension support assembly;

DETAILED DESCRIPTION

Figure 1:
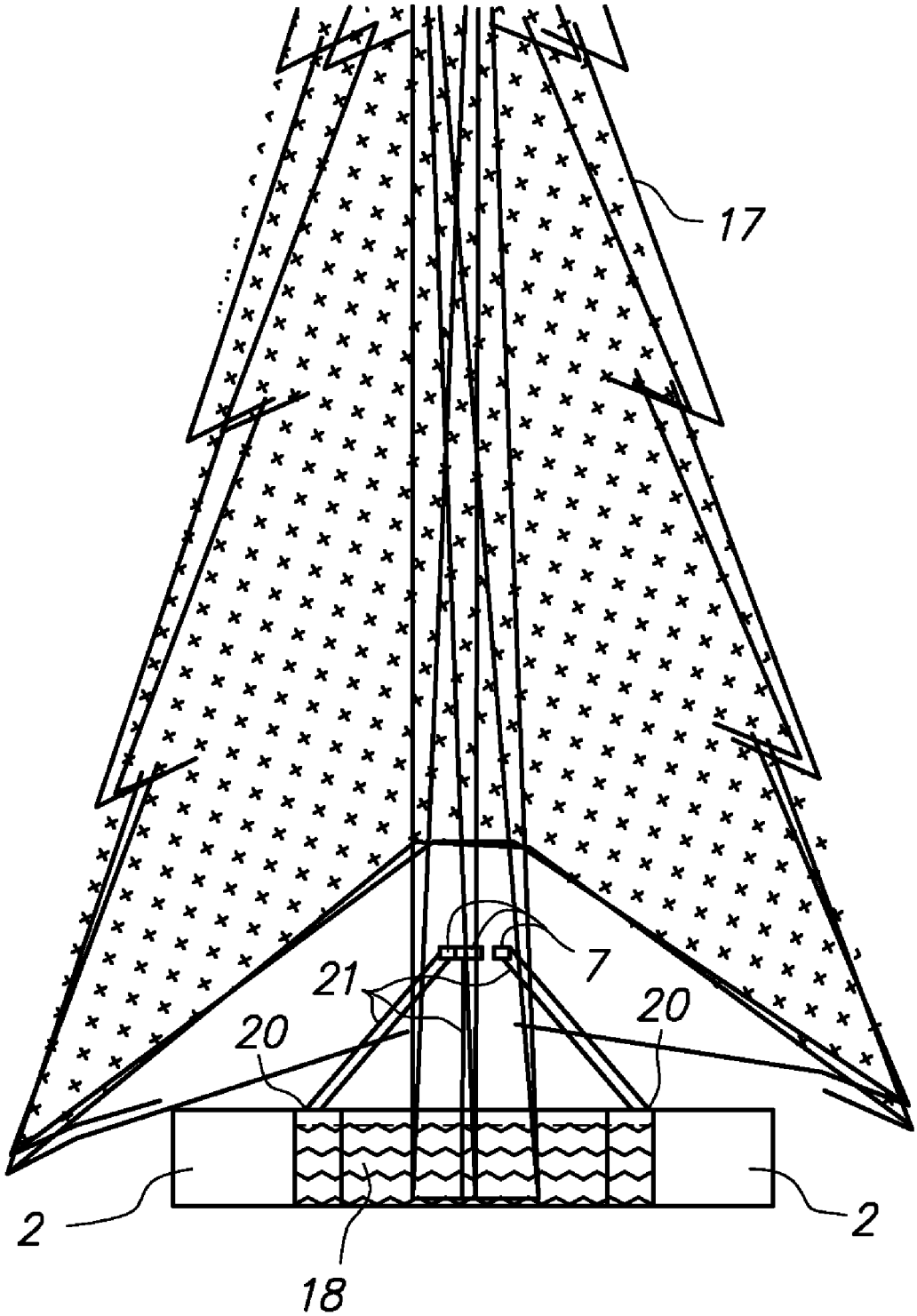
FIG. 1: shows a perspective view of the stand device in accordance with embodiments of the present invention.

Refer now to the drawings wherein depicted elements are not necessarily shown to scale and wherein like or similar elements are designated by the same reference numeral through the several views.

Figure 2:
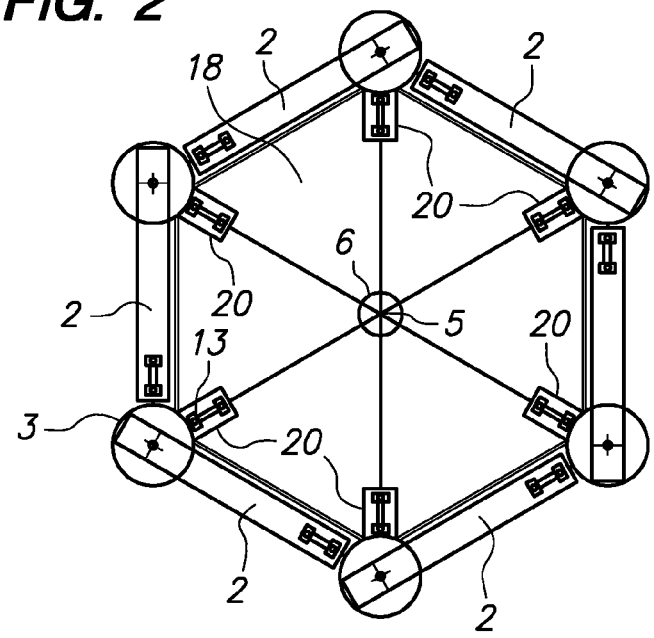
FIG. 2: shows a plan view with extendable supports retracted in accordance with embodiments of the present invention.
Figure 3:
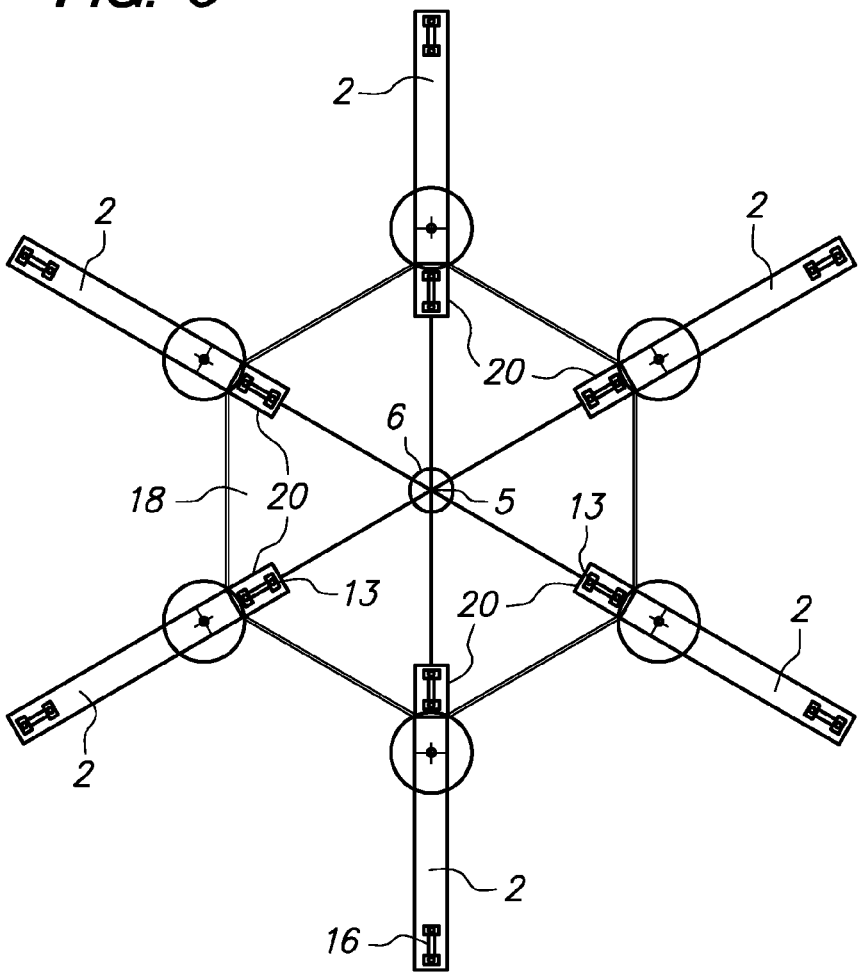
FIG. 3: shows a plan view with extendable support assembly extended in accordance with embodiments of the present invention.
Figure 11:
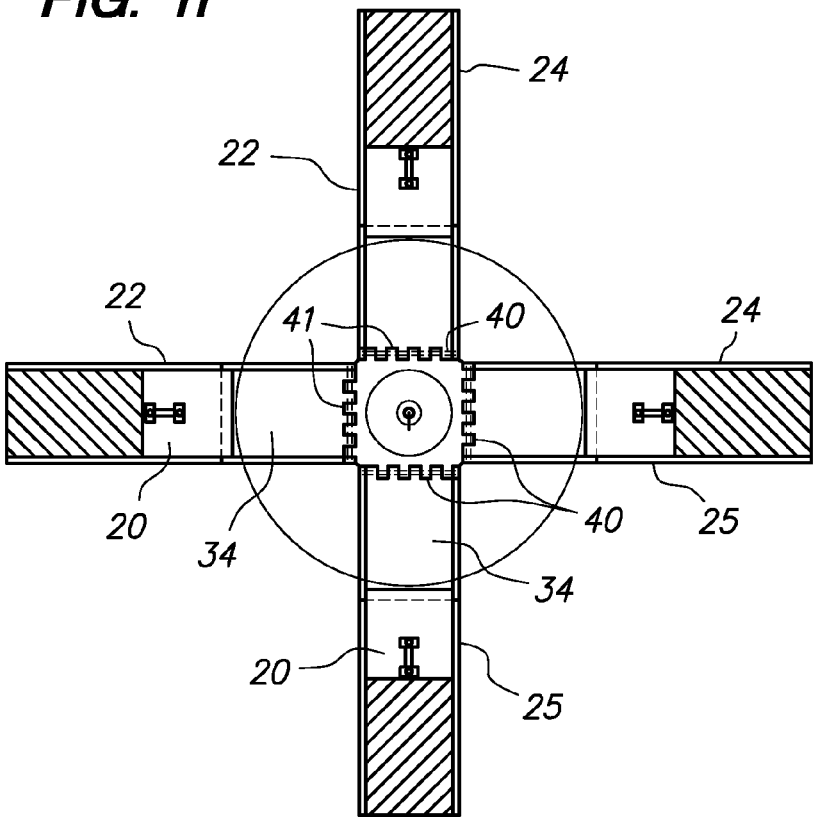
FIG. 11: shows a plan view of the stand device with cross-members attached to a separate reservoir.

With reference now to the drawings provided in FIGS. 1-18, a tree stand device disclosed herein is described. For illustrative purpose, specific dimensions and materials may be listed, but the scope of the invention is not limited to the specific dimensions listed herein. In accordance with various embodiments, FIG. 1 shows a stand (1) that has as a base with an integral reservoir (18) around which at least three attachment points (20), as shown in FIGS. 2 and 3, are equally spaced from each other and each equally spaced from the center of the integral reservoir (18). One end of the bracing support (21) is attached to one of the attachment points (20) and the other end of the bracing support (21) is attached to the tree trunk. In one embodiment, the attachment points to the tree trunk are approximately spaced at equal distances around the trunk. In another embodiment as shown in FIG. 7, a base not including an integral reservoir (18) may have four attachment points (20), as shown in FIG. 11, equally spaced from each other and each equally spaced from the center of the separate reservoir (27). Four telescoping bracing supports (21) are attached to each of the attachment points (20) and the opposite ends of the telescoping bracing supports (21) are attached to four points spaced approximately equidistant around the trunk. Telescoping and locking legs used as part of a stand device have been described. See, for example, U.S. Pat. Nos. 7,124,985, 6,536,723, 6,920,834, 7,176,366, 3,164,351 and 676,362, all of which are hereby fully incorporated by reference.

Figure 16:
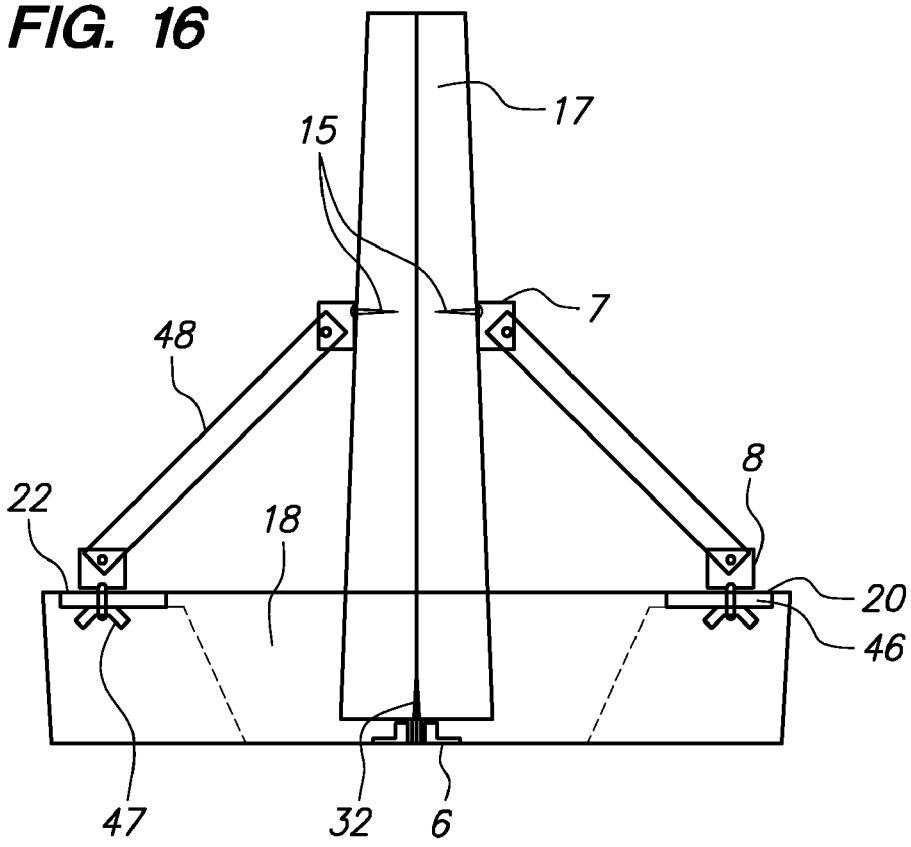
FIG. 16: shows a side view of the stand device with fixed length bracing supports.
Figure 17:
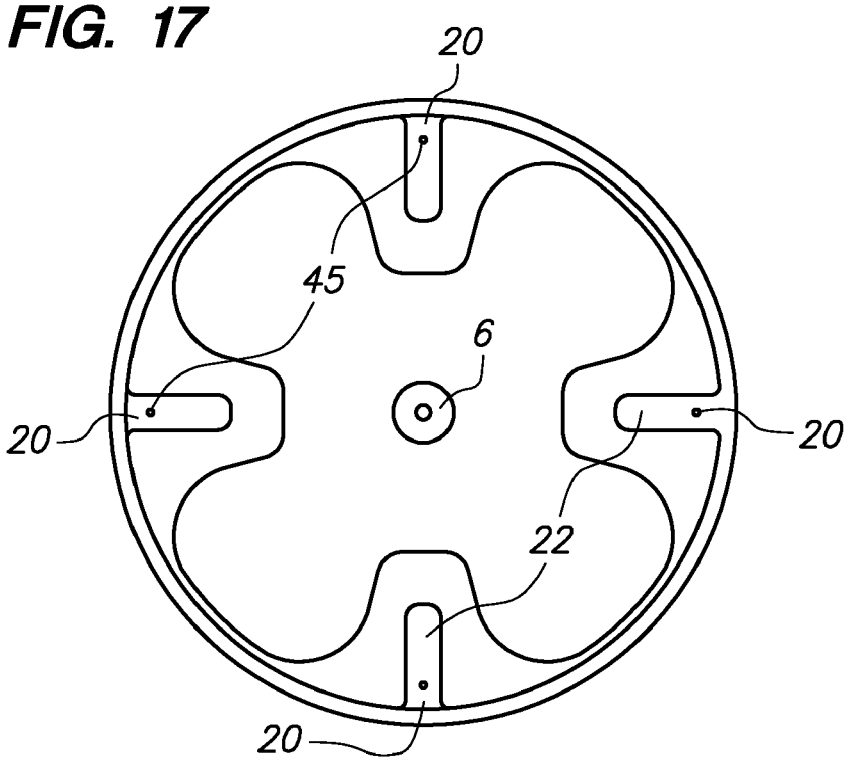
FIG. 17: shows a plan view of the stand device with integral reservoir and mounting holes for bracing supports.
Figure 18:
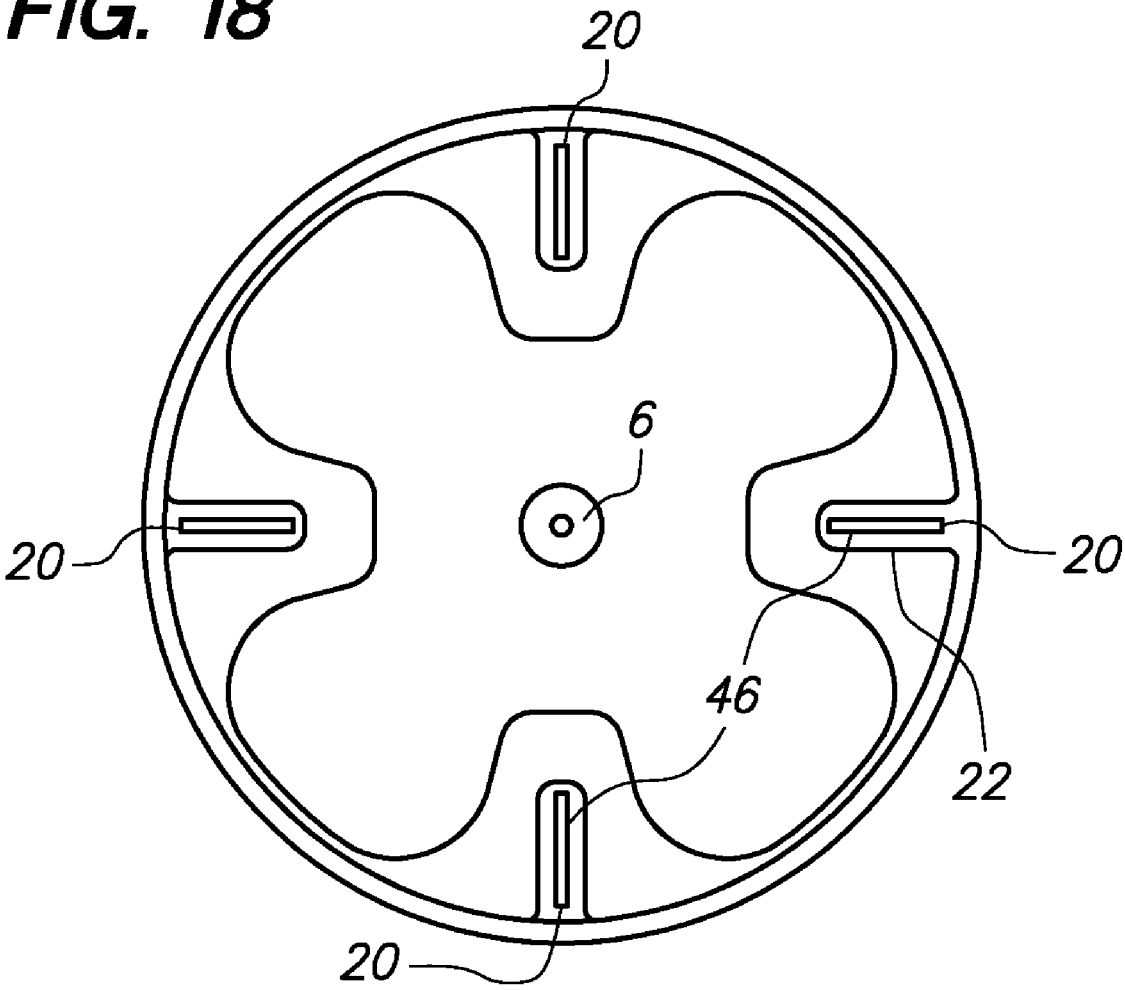
FIG. 18: shows a plan view of the stand device with integral reservoir and mounting slots for bracing supports.

In another embodiment, as shown in FIG. 16, a fixed length bracing support (48) is utilized. The bracing support (48) is fitted with an upper support swivel hinge (5) on an end that attaches to the tree and is fitted with a lower support swivel (8) on the end that attaches to the attachment point (20). As shown in FIG. 16 each lower support swivel (8) attaches to an attachment point (20) and each upper support swivel hinge (5) attaches to the trunk to create the bracing support (12). As shown in FIGS. 16 and 17 the attachment points (20) are provided with a mounting hole (45) through the surface for receiving a fastener for securing one end of the bracing supports (48). For example, the fastener may be a threaded attachment screw that passes through a mounting hole provided by the attachment point (20). The screw is retained on the underside of the attachment point (20) by the use of a nut and/or washer. In another embodiment, the attachment points (20) provide a mounting slot (46) for receiving the fastener. When a mounting slot (46) is used the threaded attachment screw allows the bracing support (48) to be repositioned along the mounting slot (46) and a nut may be tightened to retain the bracing support (48) in a selected position, which allows the item being displayed to be easily adjusted into a desired position. In another embodiment, bracing supports (48) can be replaced with telescoping supports discussed herein.

The elevated platform (22) as shown in FIGS. 9, 7, and 16 provides a raised plane for attachment points (20) for the bracing supports (21, 48), which allows the bracing supports (21, 48) to reach higher up the tree corresponding to the height of the elevated platform (22) while maintaining the desired angle of support necessary to hold the tree (17). The elevated platform (22) additionally allows a deeper reservoir to be placed under the telescoping bracing supports (21), thereby providing increased water capacity to the tree (17).

Figure 4:
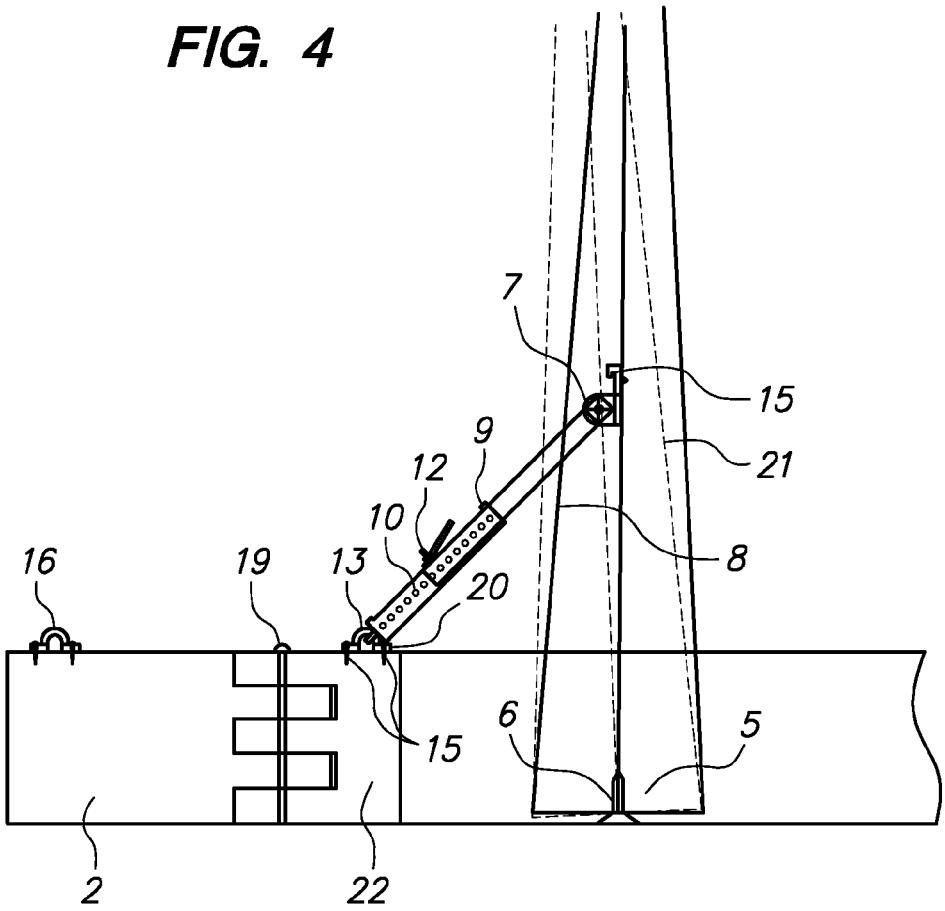
FIG. 4: shows a side view of a typical telescoping bracing supports and typical extendable support assembly in accordance with embodiments of the present invention.
Figure 6:
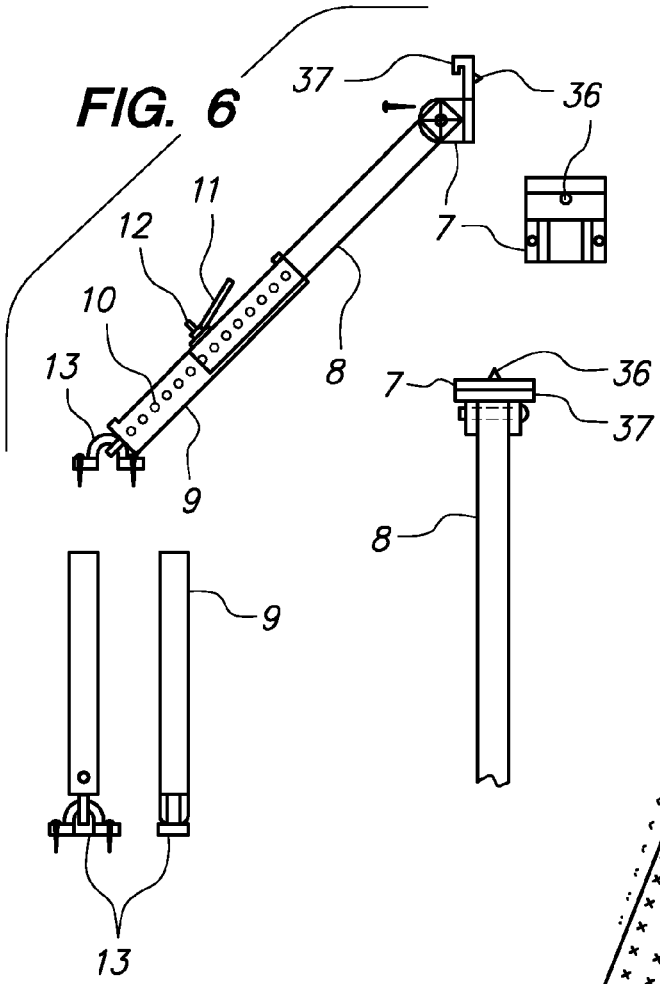
FIG. 6: shows detail of an upper swivel hinge and lower swivel ring in accordance with embodiments of the present invention.
Figure 7:
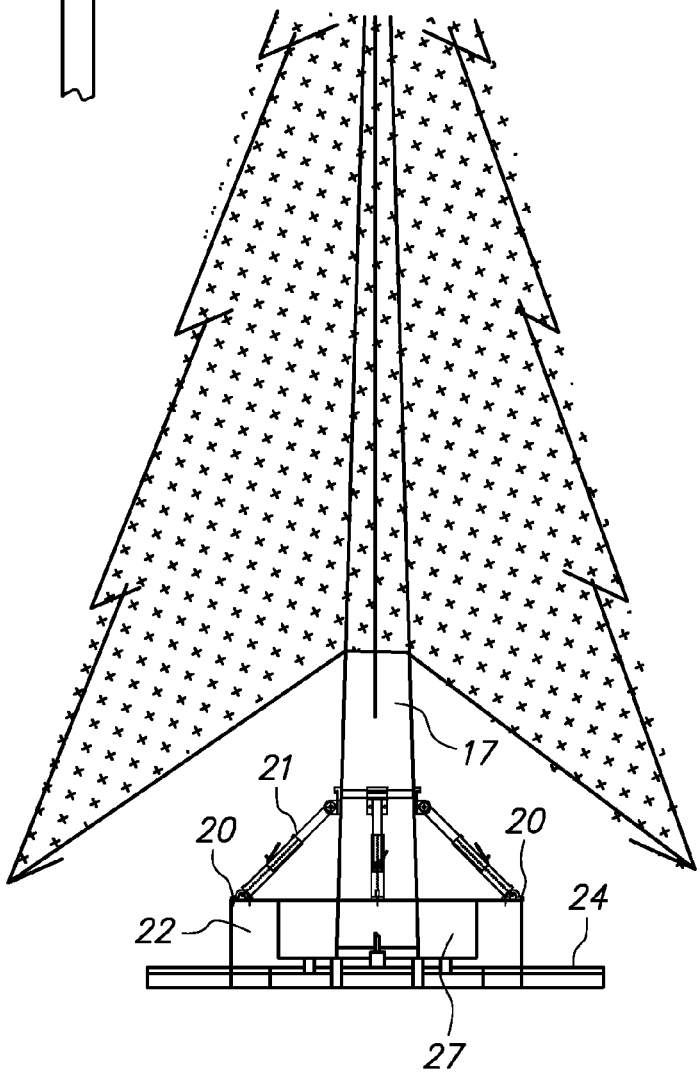
FIG. 7: shows a perspective view of the stand device in accordance with embodiments of the present invention.
Figure 8:
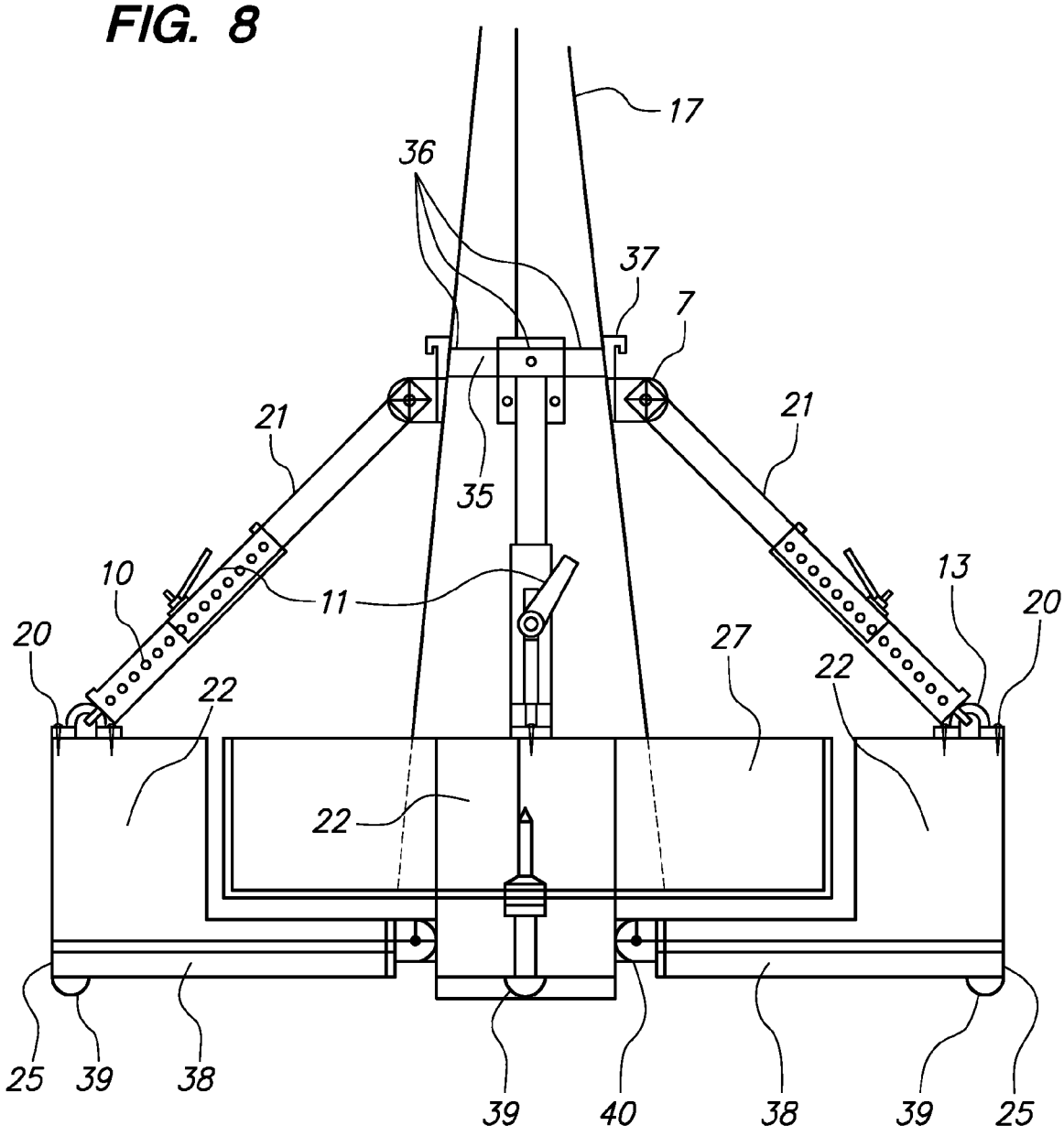
FIG. 8: shows a side view of typical telescoping bracing supports and stand device with cross-member configuration.

In embodiments providing telescoping bracing supports (21), such as shown in FIG. 6, a telescoping inner member (8) is fitted with an upper support swivel hinge (7) on the end that attaches to the tree and a telescoping outer member (9) is fitted with a lower support swivel ring (13) on the end that attaches to the attachment point (20). In another embodiment, an upper support swivel hinge (7) and a lower support swivel ring (13) may be switch to be fitted on a telescoping outer member (9) and a telescoping inner member (8). As shown in FIG. 4 each lower support ring (13) attaches to an attachment point (20) and each upper support swivel hinge (7) attaches to the trunk to create the telescoping bracing support (21). As shown in FIG. 4 and FIG. 8 the telescoping inner member (8) is designed to move laterally within telescoping tube outer member (9) and a releasable locking mechanism (11) is used to retain the selected length of the telescoping bracing support (21). Telescoping means can be accomplished by any shape of material that allows one member to be move laterally within another.

Figure 15:
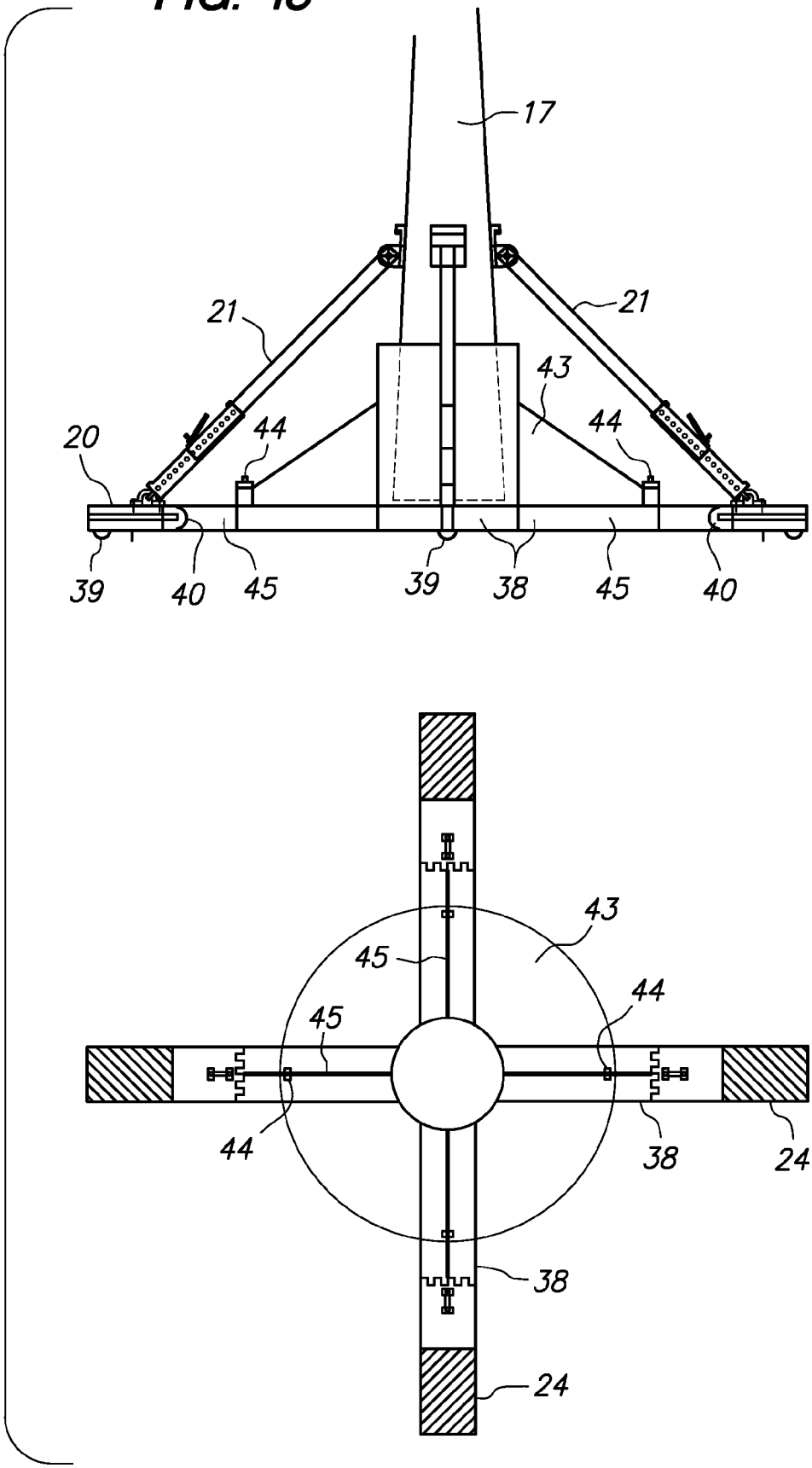
FIG. 15: shows cross-section and plan views of stand device with hinged cross members.

In embodiments shown in FIGS. 15 and 16, bracing supports (21, 48) can be attached to a tree with a removable fastener, such as wood screws, nails, and any other suitable fastener. In an embodiment shown in FIG. 8, a removable adjustable collar (35) is placed around the tree. When the collar (35) is tightened around the trunk, the upper support swivel hinge (7) is retained at the desired point to brace the tree. When a band clamp is used as a collar (35), the tightening of the band clamp causes the barb (36) of the upper support swivel hinge (7) to penetrate the tree to provide additional stability of the position selected for bracing. In some embodiments, each upper support swivel hinge (7) can be fitted to a "C" type clamp so that when each clamp is applied to the tree each upper support swivel hinge (7) is attached at the desired point to brace the tree. While these methods have been described, these components are exemplary and other mechanical equivalent means can be substituted.

Figure 5:
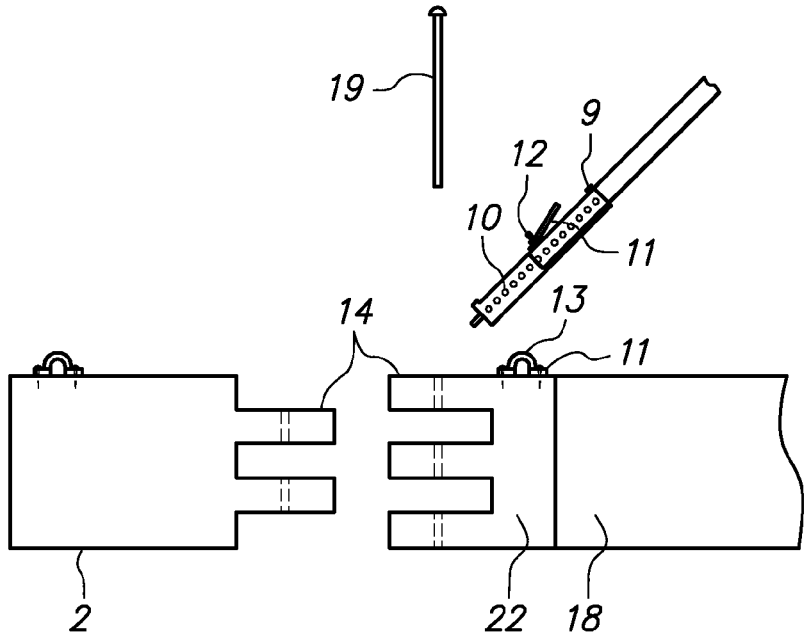
FIG. 5: shows a cross-section view of an integral reservoir and spike support in accordance with embodiments of the present invention.
Figure 13:
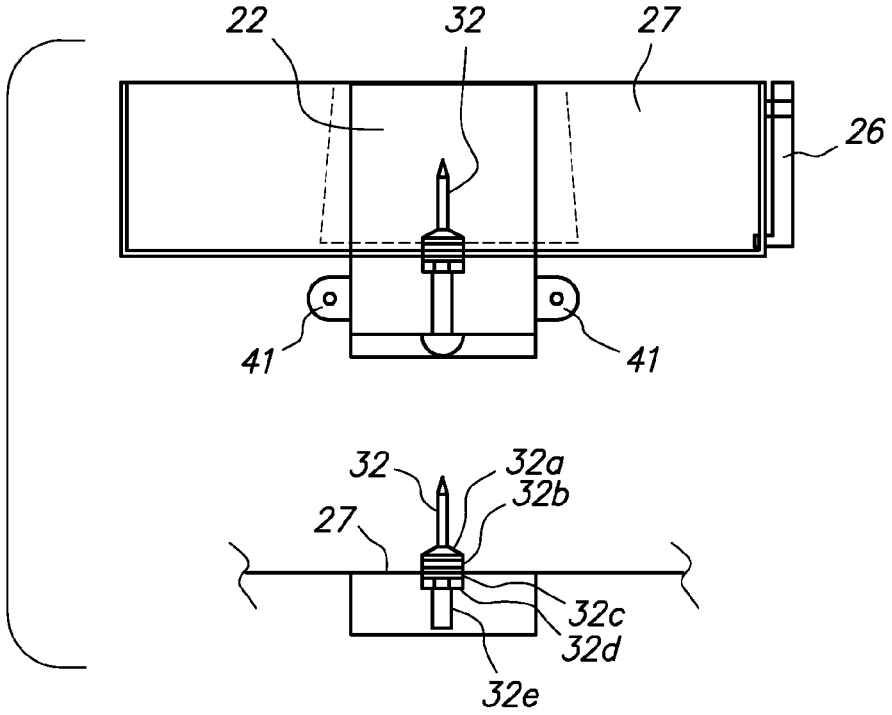
FIG. 13: shows a cross-section of a separate reservoir.
Figure 14:
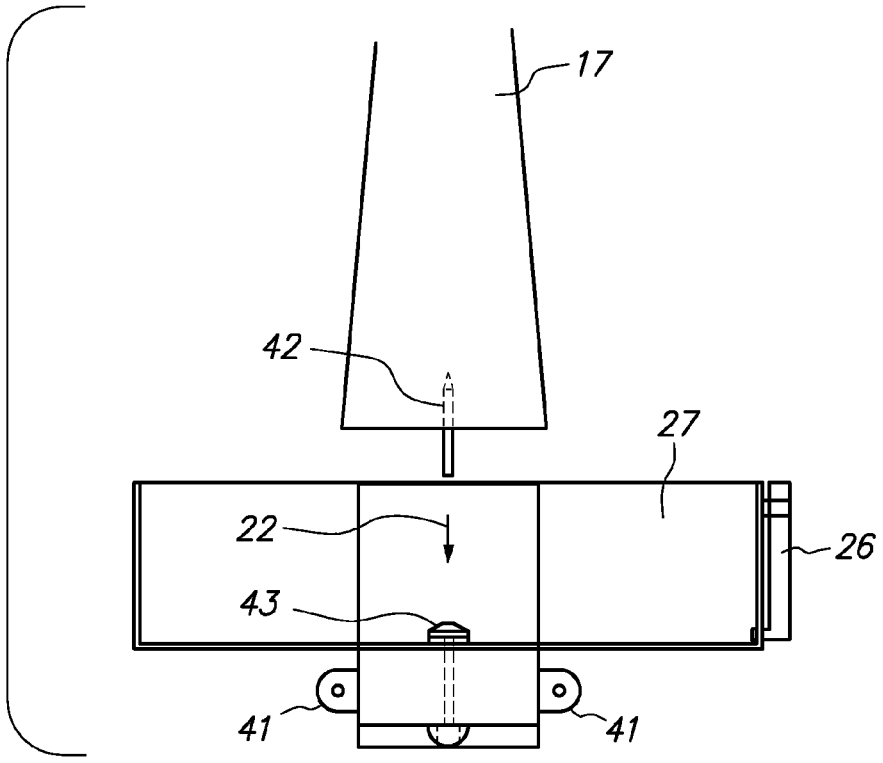
FIG. 14: shows a cross-section of a separate reservoir without an integral spike assembly.

FIG. 5 and FIG. 13 show a spike (5) and spike assembly (32) respectively upon which the trunk of a Christmas tree is impaled and used to provide a pivot point against which the telescoping bracing supports (21, 48) react. FIG. 14 shows a spike (42) that has been driven into the near center of the cut end of the trunk of the tree (17). Once the tree (17) has been impaled on the spike assembly (32), or, as shown in FIG. 14, the spike (42) has been driven into the tree (17), the exposed end of the spike (42) can be placed into the center hole of the cam node (43). Ends of each of the telescoping bracing supports (21, 48) may be attached to the tree (17) and temporarily locked, and the tree (17) and stand (1) can be placed in a desired area of the floor. Any necessary adjustment can be made to the positioning of the tree (17) by disengaging the locking mechanism (11) of each of the telescoping bracing supports (21) and moving the tree (17) in the desired direction into desired position, then the tree (17) may be locked into the desired position by engaging the releasable locking mechanism (11) of each telescoping bracing support (21) to hold the tree (17) in the selected position. In another embodiment shown in FIG. 16, a spike (42) upon which the trunk of a Christmas tree is impaled is utilized to provide the pivot point against which the bracing supports (48) react. The spike (42) can be driven into the tree (7) and the exposed end of the spike (42) is placed into the center hole of the cam node (6). Ends of each of the bracing supports (48) are attached to the tree (7) and temporarily locked to the mounting slot (46). The tree (7) and stand (1) can be placed so that base of the stand (1) sits on the floor, if they are not already in such a position. Any desired adjustments can be made to the position of the tree (7) by disengaging the wing nut (47) of each of the bracing supports (48) and moving the tree (7) in the desired direction into a more desirable position. By disengaging wing nuts (47), bracing supports (48) may slide along mounting slots (46) shown in FIG. 18. Once the tree (7) is in a desired position, the wing nut (47) of each bracing support (48) is tightened to hold the tree (7) in the selected position. As shown in FIGS. 2 and 3, the stand provides at least three (3) pivotable extension arm (2) which pivot away from the integral reservoir (18) wall. The pivotable extension arms (2) are on the same plane as the floor of the bottom side of the integral reservoir (18), and the extension arms are utilized to extend the effective support diameter of the base of the stand.

Figure 12:
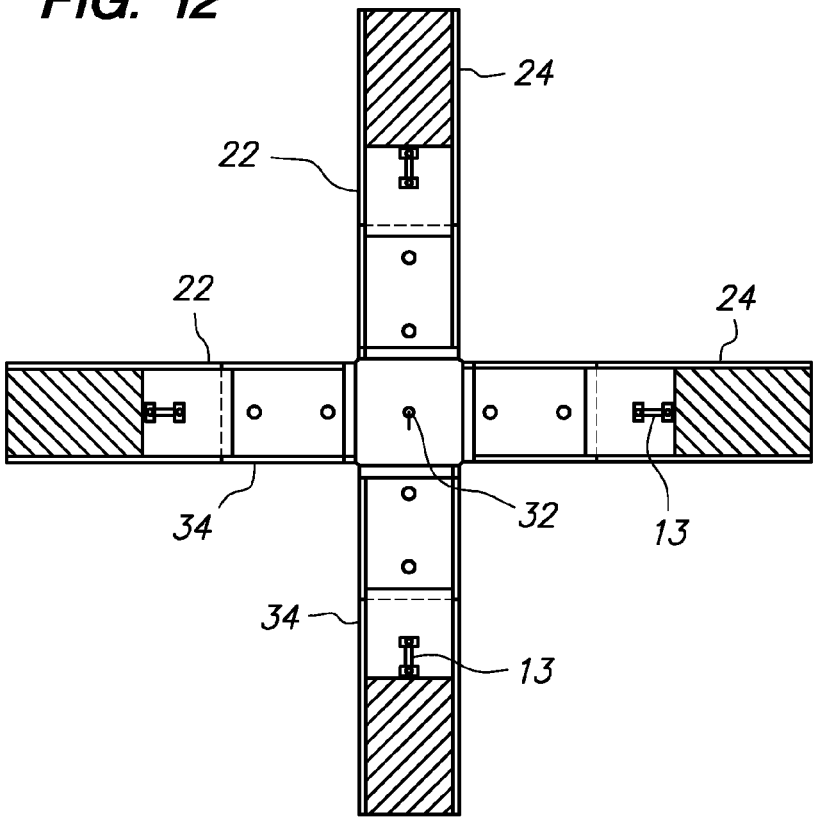
FIG. 12: shows a plan view of the stand device with interlocking cross-members.

An alternate embodiment of the stand (1), as shown in FIG. 7, provides an extension support assembly that employs two interlocking cross members (34) as shown in FIG. 12 to create a platform base on which a separate reservoir can be fitted. As shown in FIGS. 9, 10, 11 and 12 the underside of the interlocking cross members (34) is fitted with the extension support assembly, (25) which is comprised of extension rails (23) and base extensions (24). Base extensions slide outwardly along the extension rail (23) to provide expansion of the effective diameter of the stand (1) for increased stability of the tree being displayed in the stand (1). An alternate embodiment of the stand (1) employs retractable telescoping extensions that are parallel to the floor and have contact points that are on the same plane as the bottommost side of the stand (1) to the floor. The stand is easily disassembled at the end of the season for storage.

As shown in FIG. 11 and FIG. 8, the cross member (38) may be fitted with a hinge assembly (40) to interlock the cross members (34), which allows the foot (39) of the hinged cross member (38) to remain in engagement with the floor when the stand (1) is used on floors that are not level. The reservoir (27) as shown in FIGS. 11 and 13 provides interlocking members (41) which after the hinged cross member (38) is placed and aligned a pin can be inserted to engage the holes of the interlocking member (41) and the holes of the hinged cross member (38) to create the hinge assembly (40). When the telescoping bracing support (21) is attached to the tree the weight of the tree causes the foot (39) to engage the floor and resist the weight thereby providing the bracing desired for the tree. Alternatively, each hinged portion of the extension support assembly (25) and pivotable extension arm (2) can be shimmed or fitted with screw type leveling apparatus similar to table leg adjusters to accommodate floors that are not level.

To use the stand (1) all of the telescoping bracing support (21) telescoping sections are set and locked in a neutral position which is midway of the telescoping range. This makes the telescoping bracing supports (21) all the same length from the attachment point (20) to the tip of the end of the telescoping bracing support (21) that attaches to the tree trunk. For embodiments utilizing fixed length bracing supports (48), the lower support swivel (13) of each bracing support (48) is set and temporarily locked in a neutral position which is midway in the mounting slot (46).

When the stand (1) is to be attached while the tree is lying horizontally on the floor, the tree trunk should be kept substantially perpendicular to the floor of the integral reservoir (18) or the floor of the detachable reservoir (27). In order to minimize the adjustment of the telescoping bracing supports (21) during the initial phase of use, the spike assembly (32) is placed near the center of the trunk or the spike (42) is driven partially into the near center of the trunk with a hammer leaving an exposed portion. A hole may be drilled in the center of the trunk or nail can be partially driven into the trunk and then remove leaving a pilot hole for the spike (5) or the spike assembly (32). The spike (5) or the cam node (6) and the spike assembly (32) may be placed near pilot hole or near the center of the trunk and moved so that they find the pilot hole or near the center of the trunk. A hammer is used to strike the underside of the stand (1) at the center to drive the spike into the near center of the cut end of the trunk. When the force of the hammer is applied, if the tree trunk has been drilled for display or for use with another type stand the tapered cam node (6) will engage the sides of the drilled hole. In the case where the stand (1) uses a detachable reservoir (27) without a spike assembly (32), as shown in FIG. 14, the exposed end of the spike (42) driven into the trunk is inserted into the center hole of the cam node (43). In other situations, the stand (1) may be attached while the tree is placed vertically in the stand (1) near as possible to the center of the trunk. Alternatively, if there is a hole that has been drilled for display or use with another type of stand, the tree can be placed on the spike (5) and cam node (6) and the weight of the tree will cause the spike (5) to penetrate the tree trunk and the cam node (6) to engage the side of the hole. When the tree is attached to the stand (1) in a horizontal position, the tree and stand may need to be rotated after attaching the first telescoping bracing support (21) such that the next and each other telescoping bracing support (21) can be attached to the tree. When the tree is attached to the stand (1) in a vertical position, once the first telescoping bracing support (21) has been attached, the user may need to move around the tree to attach the next and each other telescoping bracing support (21) to the tree.

The telescoping bracing supports (21) are attached by removable attachment means such as wood screws (15) substantially equidistant around the trunk without changing the lengths of the telescoping bracing supports (21). However, in the event that any one of the telescoping bracing supports (21) cannot engage the tree without interference from a branch, the releasable locking mechanism (11) of that telescoping bracing support (21) can be disengaged and the telescoping bracing support (21) can be repositioned to prevent interference from the branch. The releasable locking mechanism (11) is then reapplied so that the swivel hinge (7) can be attached away the interfering branch. While keeping the trunk still substantially perpendicular to the stand (1), the swivel hinge (7) of the telescoping bracing supports (21) will be attached using removable attachment means such as wood screws (15) inserted through the holes provided. In some embodiments, there may be a location around the trunk that allows all of the telescoping bracing supports (21) to be aligned. When the telescoping bracing supports (21) can be align at such a position, the telescoping bracing supports (21) can be attached by inserting the retainer lip (37) of the swivel hinge (7) under a collar (35) similar to an adjustable band clamp. The collar (35) is fastened around the trunk of the tree at the height sufficient to allow the telescoping bracing supports (21) to brace the tree.

If the tree was attached in a horizontal position, the tree is tilted up so that the bottom side of the stand (1) is resting on the floor and the tree is in a more vertical position. At this point the pivotable extension arm (2) as shown in FIGS. 2 and 3, or the base extension (24) as shown in FIGS. 10, 11 and 12 can be partially or fully deployed. If the position of the tree is not as vertical as desired, the releasable locking mechanism (11) of all telescoping section of each telescoping bracing support (21) can be unlocked and the tree can be freely moved to a position that is desired and the releasable locking mechanism (11) of each telescoping bracing support (21) telescoping section can each be locked thereby retaining the tree in the position selected. The free movement of the tree is provided by the pivot point created by the spike (5), the clearance from the bottom of the floor of the stand (1) created by the tapered cam node (6), and the swivel attachments on each end of the telescoping bracing support (21) as shown in FIG. 6. The movement of the tree in a direction away from one or more of the telescoping bracing supports (21) causes the lengthening of the telescoping bracing support (21) and the shortening of other telescoping bracing supports (21). Correspondingly, the movement may also change the angle at which each telescoping bracing support (21) provides bracing for the tree.

Once the tree has been placed in the desired position and the releasable locking mechanism (11) has been applied to each of the telescoping bracing supports (21), a quick release pin can be inserted into the hole (10) nearest to the end of each the telescoping tube inner member (8) to prevent movement of the tree from the desired position in the event that any of the releasable locking mechanism (11) is accidentally released.

In another embodiment shown in FIG. 16, fixed length bracing supports (48) may be utilized in combination with mounting slots (46). After the tree is attached to the stand and placed in a vertical position, Wing nuts (47) may be loosened to allow the tree to be moved into a desired position. As the tree is moved, the threaded attachment screws of the lower support swivel (8) move along the mounting slots (48). Correspondingly, the movement may also change the angle at which each bracing support (48) provides bracing for the tree.

The following embodiments of the present invention describe a much improved display device which allows a stable easily adjustable display method with significantly increased water supply from a reservoir. The only tools required by the invention are a screwdriver and a hammer and all parts are inexpensive to manufacture and reusable for an indefinite period of time.

The present invention provides a system whereby the bracing attachment points at the tree trunk are determined without regard to the availability of branches sufficiently strong to withstand the tension necessary to secure trees of various sizes to the base members. Since great care is taken in the growing and shaping of the Christmas tree to present as uniform of an appearance as possible, an additional benefit is that there is no unwanted re-positioning of the branches by the downward bending caused by the forces from any attachment method using the branches as a connection point.

A further advantage of the present invention is that the amount of free play in the range of motion of each of the bracing supports (48) and the amount of travel along the mounting slots (46) is sufficient to allow the ends of the bracing supports (48) to be attached approximately equidistant around the trunk while being attached to the tree at different heights, thereby allowing the user to avoid removing branches interfering with a telescoping members while providing the necessary angle of bearing to brace the tree.

A further advantage of the present invention is that the tree is firmly and securely attached to the invention and does not rely on ball sockets and other swivel means at the point of attachment to attempt to adjust the tree to vertical. The present invention achieves vertical adjustment by changing the lengths and thereby the angles of the unlocked telescoping bracing supports telescoping section by allowing the lengthening and shortening of any of the bracing supports to occur in harmony with other unlocked telescoping bracing supports while maintaining connection to the selected point of attachment to the Christmas tree. The preferred vertical adjustment is retained by applying a locking mechanism to each of the telescoping bracing supports telescoping sections.

A further advantage of the present invention is that the attached and locked telescoping bracing supports and the fixed length bracing supports when used act in harmony with each other to provide anchor points that resist twisting of the tree and either of the methods of bracing of the tree can be readjusted in the event that the moving of the tree to a different location causes the initial desired adjustment to be altered.

A further advantage of the present invention is that the water level of the reservoir is more easily monitored and maintained through use of an external sight glass (26) as shown in FIG. 13 to indicate the level of the water in the reservoir. The sight glass can be fitted with an audio or visual type alarm which can alert a user when the water level is at a predetermined low level.

A further advantage of the present invention is that the use of removable attachment means such as screws to attach the end of the telescoping bracing supports to the tree allows a user to detach and remove the tree from the invention at the end of the season while the tree is still upright, thereby leaving the reservoir and any unused water to be disposed of separately from the tree without spills due to tipping of the tree and the attached reservoir.

A further advantage of the present invention is that as shown in FIG. 15 many types of inverted conical shaped existing Christmas tree stands (43) can be attached to the cross members (38) and used as a separate reservoir. The telescoping bracing supports (21) of the present invention can then be used to provide the desired higher contact point up the tree trunk and provide the ability to more easily adjust and lock the tree in the desired display vertical display position.

From the foregoing detailed description of specific embodiments of the invention, it should be apparent that a stand for a tree that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A stand for a tree comprising:

a base for receiving a trunk of the tree, wherein the base provides a top portion and an integrated reservoir;

a plurality of attachment points positioned along a periphery of the top portion of said base, wherein each of the plurality of attachment points is a slot; and a plurality of bracing supports of a fixed length, each bracing support comprising, a first end coupled to one of the plurality of attachment points, wherein said first end is adjustable within said slot, and a second end equipped to engage the trunk of the tree.

2. The stand of claim 1 further comprising:

a spike assembly positioned centrally at a bottom of the base, wherein the spike assembly engages the trunk of the tree.

3. The stand of claim 1 further comprising:

a node coupled to the base for receiving a removable spike, wherein the removable spike is removable from the node.

4. The stand of claim 1, wherein the reservoir is equipped with a sight glass.

5. The stand of claim 1 further comprising:

a first end fastener provided at the first end of each of the plurality of bracing supports, wherein the first end fastener secures the bracing support to the attachment point.

6. The stand of claim 5, wherein the first end fastener is a multi-directional swivel hinge.

7. The stand of claim 5, wherein first end fastener comprises a swivel hinge providing a threaded screw and a nut to secure the multi-directional swivel hinge to one of the plurality of attachment points.

8. The stand of claim 5 further comprising:

a second end fastener provided at the second end of each of the plurality of bracing supports, wherein the second end fastener secures the bracing support to the tree.

9. The stand of claim 8, wherein the second end fastener comprises a swivel hinge with at least one opening for a screw to secure the bracing support to the tree.

10. The stand of claim 1, wherein the slot extends radially from a center of the base.

* * * * *